US009273461B1

(12) United States Patent
Hohmann, Jr.

(10) Patent No.: US 9,273,461 B1
(45) **Date of Patent: *Mar. 1, 2016**

(54) THERMAL VENEER TIE AND ANCHORING SYSTEM

(71) Applicant: Columbia Insurance Company, Omaha, NE (US)

(72) Inventor: Ronald P. Hohmann, Jr., Hauppauge, NY (US)

(73) Assignee: Columbia Insurance Company, Omaha, NE (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/628,819

(22) Filed: Feb. 23, 2015

(51) Int. Cl.
*E04B 1/16* (2006.01)
*E04B 1/41* (2006.01)

(52) U.S. Cl.
CPC ..... *E04B 1/4185* (2013.01)

(58) Field of Classification Search
CPC ... E04B 1/4178; E04B 1/4185; E04B 1/2608; E04B 1/41; E04B 2/30
USPC ..... 52/378–379, 383, 508, 513, 712–714, 52/506.1, 562, 649.1, 443–444, 506.05, 52/506.06
See application file for complete search history.

(56) References Cited

U.S. PATENT DOCUMENTS

| | | | |
|---|---|---|---|
| 819,869 | A | 5/1906 | Dunlap |
| 903,000 | A | 11/1908 | Priest |
| 1,014,157 | A | 1/1912 | Lewen |
| 1,170,419 | A | 2/1916 | Coon et al. |
| RE15,979 | E | 1/1925 | Schaefer et al. |
| 1,794,684 | A | 3/1931 | Handel |
| 1,936,223 | A | 11/1933 | Awbrey |
| 1,988,124 | A | 1/1935 | Johnson |
| 2,058,148 | A | 10/1936 | Hard |
| 2,097,821 | A | 11/1937 | Mathers |
| 2,280,647 | A | 4/1942 | Hawes |
| 2,300,181 | A | 10/1942 | Spaight |
| 2,343,764 | A | 3/1944 | Fuller |
| 2,403,566 | A | 7/1946 | Thorp et al. |

(Continued)

FOREIGN PATENT DOCUMENTS

| | | |
|---|---|---|
| CH | 279209 | 3/1952 |
| EP | 0 199 595 B1 | 3/1995 |

(Continued)

OTHER PUBLICATIONS

ASTM Standard E754-80 (2006), Standard Test Method for Pullout Resistance of Ties and Anchors Embedded in Masonry Mortar Joints, ASTM International, 8 pages, West Conshohocken, Pennsylvania, United States.

(Continued)

*Primary Examiner* — Beth Stephan
(74) *Attorney, Agent, or Firm* — Senniger Powers LLP

(57) ABSTRACT

A veneer tie for use in a cavity wall to connect to a wall anchor to join an inner wythe and an outer wythe of the cavity wall includes an insertion portion configured for disposition in a bed joint of the outer wythe. A cavity portion is contiguous with the insertion portion, and a pintle is contiguous with the cavity portion and configured for attachment to a receptor of the wall anchor. A thermal coating is disposed on the pintle, the thermal coating being configured and arranged to reduce thermal transfer in the cavity wall between the veneer tie and the wall anchor when attached to the pintle.

20 Claims, 6 Drawing Sheets

(56) References Cited

U.S. PATENT DOCUMENTS 2,413,772 A 1/1947 Morehouse
2,605,867 A 8/1952 Goodwin
2,780,936 A 2/1957 Hillberg
2,898,758 A 8/1959 Henrickson
2,909,054 A 10/1959 Phillips
2,929,238 A 3/1960 Kaye
2,966,705 A 1/1961 Massey
2,999,571 A 9/1961 Huber
3,030,670 A 4/1962 Bigelow
3,088,361 A 5/1963 Hallock
3,114,220 A 12/1963 Maddox et al.
3,121,978 A 2/1964 Reiland
3,183,628 A 5/1965 Smith
3,254,736 A 6/1966 Gass
3,277,626 A 10/1966 Brynjolfsson et al.
3,300,939 A 1/1967 Brynjolfsson et al.
3,309,828 A 3/1967 Tribble
3,310,926 A 3/1967 Brandreth et al.
3,341,998 A 9/1967 Lucas
3,377,764 A 4/1968 Storch
3,440,922 A 4/1969 Cohen
3,478,480 A 11/1969 Swenson
3,529,508 A 9/1970 Cooksey
3,563,131 A 2/1971 Ridley, Sr.
3,568,389 A 3/1971 Gulow
3,640,043 A 2/1972 Querfeld et al.
3,925,996 A 12/1975 Wiggill
3,964,226 A 6/1976 Hala et al.
3,964,227 A 6/1976 Hala
4,021,990 A 5/1977 Schwalberg
4,227,359 A 10/1980 Schlenker
4,238,987 A 12/1980 Siebrecht-Reuter
4,281,494 A 8/1981 Weinar
4,305,239 A 12/1981 Geraghty
4,373,314 A 2/1983 Allan
4,382,416 A 5/1983 Kellogg-Smith
4,410,760 A 10/1983 Cole
4,424,745 A 1/1984 Magorian et al.
4,438,611 A 3/1984 Bryant
4,473,984 A 10/1984 Lopez
4,482,368 A 11/1984 Roberts
4,571,909 A 2/1986 Berghuis et al.
4,596,102 A 6/1986 Catani et al.
4,598,518 A 7/1986 Hohmann
4,606,163 A 8/1986 Catani
4,622,796 A 11/1986 Aziz et al.
4,628,657 A 12/1986 Ermer et al.
4,636,125 A 1/1987 Burgard
4,640,848 A 2/1987 Cerdan-Diaz et al.
4,660,342 A 4/1987 Salisbury
4,688,363 A 8/1987 Sweeney et al.
4,703,604 A 11/1987 Muller
4,708,551 A 11/1987 Richter et al.
4,714,507 A 12/1987 Ohgushi
4,723,866 A 2/1988 McCauley
4,738,070 A 4/1988 Abbott et al.
4,757,662 A 7/1988 Gasser
4,764,069 A 8/1988 Reinwall et al.
4,819,401 A 4/1989 Whitney, Jr.
4,827,684 A 5/1989 Allan
4,843,776 A 7/1989 Guignard
4,852,320 A 8/1989 Ballantyne
4,869,038 A 9/1989 Catani
4,869,043 A 9/1989 Hatzinikolas et al.
4,875,319 A 10/1989 Hohmann
4,911,949 A 3/1990 Iwase et al.
4,922,680 A 5/1990 Kramer et al.
4,923,348 A 5/1990 Carlozzo et al.
4,946,632 A 8/1990 Pollina
4,948,319 A 8/1990 Day et al.
4,955,172 A 9/1990 Pierson
4,993,902 A 2/1991 Hellon
5,063,722 A 11/1991 Hohmann
5,099,628 A 3/1992 Noland et al.
5,207,043 A 5/1993 McGee et al.
5,307,602 A 5/1994 Lebraut
5,392,581 A 2/1995 Hatzinikolas et al.
5,395,196 A 3/1995 Notaro
5,408,798 A 4/1995 Hohmann
5,440,854 A 8/1995 Hohmann
5,454,200 A 10/1995 Hohmann
5,456,052 A 10/1995 Anderson et al.
5,490,366 A 2/1996 Burns et al.
5,518,351 A 5/1996 Peil
5,598,673 A 2/1997 Atkins
5,634,310 A 6/1997 Hohmann
5,669,592 A 9/1997 Kearful
5,671,578 A 9/1997 Hohmann
5,673,527 A 10/1997 Coston et al.
5,755,070 A 5/1998 Hohmann
5,816,008 A 10/1998 Hohmann
5,819,486 A 10/1998 Goodings
5,845,455 A 12/1998 Johnson, III
6,000,178 A 12/1999 Goodings
6,125,608 A 10/2000 Charlson
6,176,662 B1 1/2001 Champney et al.
6,209,281 B1 4/2001 Rice
6,279,283 B1 * 8/2001 Hohmann et al. ..... 52/379
6,284,311 B1 9/2001 Gregorovich et al.
6,293,744 B1 9/2001 Hempfling et al.
6,332,300 B1 12/2001 Wakai
6,351,922 B1 3/2002 Burns et al.
6,367,219 B1 4/2002 Quinlan
6,508,447 B1 1/2003 Catani et al.
6,548,190 B2 4/2003 Spitsberg et al.
6,612,343 B2 9/2003 Camberlin et al.
6,627,128 B1 9/2003 Boyer
6,668,505 B1 12/2003 Hohmann et al.
6,686,301 B2 2/2004 Li et al.
6,709,213 B2 3/2004 Bailey
6,718,774 B2 4/2004 Razzell
6,735,915 B1 5/2004 Johnson, III
6,739,105 B2 5/2004 Fleming
6,789,365 B1 * 9/2004 Hohmann et al. ..... 52/565
6,812,276 B2 11/2004 Yeager
6,817,147 B1 11/2004 MacDonald
6,827,969 B1 12/2004 Skoog et al.
6,837,013 B2 1/2005 Foderberg et al.
6,851,239 B1 2/2005 Hohmann et al.
6,918,218 B2 7/2005 Greenway
6,925,768 B2 8/2005 Hohmann et al.
6,941,717 B2 9/2005 Hohmann et al.
6,968,659 B2 11/2005 Boyer
7,007,433 B2 3/2006 Boyer
7,017,318 B1 3/2006 Hohmann et al.
7,043,884 B2 5/2006 Moreno
7,059,577 B1 6/2006 Burgett
D527,834 S 9/2006 Thimons et al.
7,147,419 B2 12/2006 Balbo Di Vinadio
7,152,382 B2 12/2006 Johnson, III
7,171,788 B2 2/2007 Bronner
7,178,299 B2 2/2007 Hyde et al.
D538,948 S 3/2007 Thimons et al.
7,225,590 B1 6/2007 diGirolamo et al.
7,325,366 B1 * 2/2008 Hohmann et al. ..... 52/513
7,334,374 B2 2/2008 Schmid
7,374,825 B2 5/2008 Hazel et al.
7,415,803 B2 8/2008 Bronner
7,469,511 B2 12/2008 Wobber
7,481,032 B2 1/2009 Tarr
7,552,566 B2 6/2009 Hyde et al.
7,562,506 B2 7/2009 Hohmann, Jr.
7,587,874 B2 9/2009 Hohmann, Jr.
7,654,057 B2 2/2010 Zambelli et al.
7,735,292 B2 6/2010 Massie
7,744,321 B2 6/2010 Wells
7,748,181 B1 7/2010 Guinn
7,788,869 B2 9/2010 Voegele, Jr.
D626,817 S 11/2010 Donowho et al.
7,845,137 B2 12/2010 Hohmann, Jr.
7,918,634 B2 4/2011 Conrad et al.
8,037,653 B2 10/2011 Hohmann, Jr.
8,051,619 B2 11/2011 Hohmann, Jr.
8,092,134 B2 1/2012 Oguri et al.

(56) References Cited

U.S. PATENT DOCUMENTS

| | | | | |
|---|---|---|---|---|
| 8,096,090 | B1 | 1/2012 | Hohmann, Jr. et al. | |
| 8,109,706 | B2 | 2/2012 | Richards | |
| 8,122,663 | B1 * | 2/2012 | Hohmann et al. | 52/379 |
| 8,154,859 | B2 | 4/2012 | Shahrokhi | |
| 8,201,374 | B2 | 6/2012 | Hohmann, Jr. | |
| 8,209,934 | B2 | 7/2012 | Pettingale | |
| 8,215,083 | B2 | 7/2012 | Toas et al. | |
| 8,291,672 | B2 | 10/2012 | Hohmann, Jr. et al. | |
| 8,347,581 | B2 | 1/2013 | Doerr et al. | |
| 8,375,667 | B2 | 2/2013 | Hohmann, Jr. | |
| 8,418,422 | B2 | 4/2013 | Johnson, III | |
| 8,511,041 | B2 | 8/2013 | Fransen | |
| 8,516,763 | B2 | 8/2013 | Hohmann, Jr. | |
| 8,516,768 | B2 | 8/2013 | Johnson, III | |
| 8,544,228 | B2 | 10/2013 | Bronner | |
| 8,555,587 | B2 | 10/2013 | Hohmann, Jr. | |
| 8,555,596 | B2 | 10/2013 | Hohmann, Jr. | |
| 8,596,010 | B2 | 12/2013 | Hohmann, Jr. | |
| 8,609,224 | B2 | 12/2013 | Li et al. | |
| 8,613,175 | B2 * | 12/2013 | Hohmann, Jr. | 52/379 |
| 8,635,832 | B2 | 1/2014 | Heudorfer et al. | |
| 8,661,766 | B2 | 3/2014 | Hohmann, Jr. | |
| 8,667,757 | B1 * | 3/2014 | Hohmann, Jr. | 52/513 |
| 8,726,596 | B2 | 5/2014 | Hohmann, Jr. | |
| 8,726,597 | B2 | 5/2014 | Hohmann, Jr. | |
| 8,733,049 | B2 | 5/2014 | Hohmann, Jr. | |
| 8,739,485 | B2 | 6/2014 | Hohmann, Jr. | |
| 8,800,241 | B2 | 8/2014 | Hohmann, Jr. | |
| 8,833,003 | B1 | 9/2014 | Hohmann, Jr. | |
| 8,839,581 | B2 | 9/2014 | Hohmann, Jr. | |
| 8,839,587 | B2 | 9/2014 | Hohmann, Jr. | |
| 8,844,229 | B1 | 9/2014 | Hohmann, Jr. | |
| 8,863,460 | B2 * | 10/2014 | Hohmann, Jr. | 52/513 |
| 8,881,488 | B2 | 11/2014 | Hohmann, Jr. et al. | |
| 8,898,980 | B2 | 12/2014 | Hohmann, Jr. | |
| 8,904,726 | B1 | 12/2014 | Hohmann, Jr. | |
| 8,904,727 | B1 * | 12/2014 | Hohmann, Jr. | 52/379 |
| 8,904,730 | B2 | 12/2014 | Hohmann, Jr. | |
| 8,904,731 | B2 | 12/2014 | Hohmann, Jr. et al. | |
| 8,910,445 | B2 | 12/2014 | Hohmann, Jr. | |
| 8,920,092 | B2 | 12/2014 | D'Addario et al. | |
| 8,984,837 | B2 | 3/2015 | Curtis et al. | |
| 2001/0054270 | A1 | 12/2001 | Rice | |
| 2002/0047488 | A1 | 4/2002 | Webb et al. | |
| 2002/0100239 | A1 | 8/2002 | Lopez | |
| 2003/0121226 | A1 | 7/2003 | Bolduc | |
| 2003/0217521 | A1 | 11/2003 | Richardson et al. | |
| 2004/0083667 | A1 | 5/2004 | Johnson, III | |
| 2004/0187421 | A1 | 9/2004 | Johnson, III | |
| 2004/0216408 | A1 | 11/2004 | Hohmann, Jr. | |
| 2004/0216413 | A1 | 11/2004 | Hohmann et al. | |
| 2004/0216416 | A1 | 11/2004 | Hohmann et al. | |
| 2004/0231270 | A1 | 11/2004 | Collins et al. | |
| 2005/0046187 | A1 | 3/2005 | Takeuchi et al. | |
| 2005/0129485 | A1 | 6/2005 | Swim, Jr. | |
| 2005/0279042 | A1 | 12/2005 | Bronner | |
| 2005/0279043 | A1 | 12/2005 | Bronner | |
| 2006/0005490 | A1 * | 1/2006 | Hohmann, Jr. | 52/293.3 |
| 2006/0198717 | A1 | 9/2006 | Fuest | |
| 2006/0242921 | A1 | 11/2006 | Massie | |
| 2006/0251916 | A1 | 11/2006 | Arikawa et al. | |
| 2007/0011964 | A1 | 1/2007 | Smith | |
| 2007/0059121 | A1 | 3/2007 | Chien | |
| 2008/0092472 | A1 | 4/2008 | Doerr et al. | |
| 2008/0141605 | A1 | 6/2008 | Hohmann | |
| 2008/0166203 | A1 | 7/2008 | Reynolds et al. | |
| 2008/0222992 | A1 | 9/2008 | Hikai et al. | |
| 2009/0133351 | A1 | 5/2009 | Wobber | |
| 2009/0133357 | A1 | 5/2009 | Richards | |
| 2009/0173828 | A1 | 7/2009 | Oguri et al. | |
| 2010/0037552 | A1 | 2/2010 | Bronner | |
| 2010/0071307 | A1 | 3/2010 | Hohmann, Jr. | |
| 2010/0101175 | A1 | 4/2010 | Hohmann | |
| 2010/0192495 | A1 | 8/2010 | Huff et al. | |
| 2010/0257803 | A1 | 10/2010 | Hohmann, Jr. | |
| 2011/0023748 | A1 * | 2/2011 | Wagh et al. | 106/18.14 |
| 2011/0041442 | A1 | 2/2011 | Bui | |
| 2011/0047919 | A1 | 3/2011 | Hohmann, Jr. | |
| 2011/0061333 | A1 | 3/2011 | Bronner | |
| 2011/0083389 | A1 | 4/2011 | Bui | |
| 2011/0146195 | A1 | 6/2011 | Hohmann, Jr. | |
| 2011/0173902 | A1 | 7/2011 | Hohmann, Jr. et al. | |
| 2011/0189480 | A1 | 8/2011 | Hung | |
| 2011/0277397 | A1 | 11/2011 | Hohmann, Jr. | |
| 2012/0186183 | A1 | 7/2012 | Johnson, III | |
| 2012/0285111 | A1 | 11/2012 | Johnson, III | |
| 2012/0304576 | A1 | 12/2012 | Hohmann, Jr. | |
| 2012/0308330 | A1 | 12/2012 | Hohmann, Jr. | |
| 2013/0008121 | A1 | 1/2013 | Dalen | |
| 2013/0074435 | A1 * | 3/2013 | Hohmann, Jr. | 52/565 |
| 2013/0074442 | A1 | 3/2013 | Hohmann, Jr. | |
| 2013/0232893 | A1 | 9/2013 | Hohmann, Jr. | |
| 2013/0232909 | A1 | 9/2013 | Curtis et al. | |
| 2013/0247482 | A1 * | 9/2013 | Hohmann, Jr. | 52/167.1 |
| 2013/0247483 | A1 | 9/2013 | Hohmann, Jr. | |
| 2013/0247484 | A1 | 9/2013 | Hohmann, Jr. | |
| 2013/0247498 | A1 | 9/2013 | Hohmann, Jr. | |
| 2013/0340378 | A1 | 12/2013 | Hohmann, Jr. | |
| 2014/0000211 | A1 * | 1/2014 | Hohmann, Jr. | 52/699 |
| 2014/0075855 | A1 | 3/2014 | Hohmann, Jr. | |
| 2014/0075856 | A1 | 3/2014 | Hohmann, Jr. | |
| 2014/0075879 | A1 | 3/2014 | Hohmann, Jr. | |
| 2014/0096466 | A1 | 4/2014 | Hohmann, Jr. | |
| 2014/0174013 | A1 | 6/2014 | Hohmann, Jr. et al. | |
| 2014/0202098 | A1 | 7/2014 | De Smet et al. | |
| 2014/0215958 | A1 | 8/2014 | Duyvejonck et al. | |
| 2014/0250826 | A1 | 9/2014 | Hohmann, Jr. | |
| 2015/0033651 | A1 | 2/2015 | Hohmann, Jr. | |
| 2015/0096243 | A1 | 4/2015 | Hohmann, Jr. | |
| 2015/0121792 | A1 | 5/2015 | Spoo et al. | |

FOREIGN PATENT DOCUMENTS

| | | |
|---|---|---|
| GB | 1 575 501 | 9/1980 |
| GB | 2 069 024 A | 8/1981 |
| GB | 2 246 149 A | 1/1992 |
| GB | 2 265 164 A | 9/1993 |
| GB | 2459936 B | 3/2013 |

OTHER PUBLICATIONS

ASTM Standard Specification A951/A951M—11, Table 1, Standard Specification for Steel Wire for Masonry Joint Reinforcement, Nov. 14, 2011, 6 pages, West Conshohocken, Pennsylvania, United States.

State Board of Building Regulations and Standards, Building Envelope Requirements, 780 CMR sec. 1304.0 et seq., 7th Edition, Aug. 22, 2008, 11 pages, Boston, MA, United States.

Building Code Requirements for Masonry Structures and Commentary, TMS 402-11/ACI 530-11/ASCE 5-11, 2011, Chapter 6, 12 pages.

Hohmann & Barnard, Inc., Product Catalog, 44 pgs (2003).

Hohmann & Barnard, Inc.; Product Catalog, 2009, 52 pages, Hauppauge, New York, United States.

Hohmann & Barnard, Inc., Product Catalog, 2013, 52 pages, Hauppauge, New York, United States.

Kossecka, Ph.D, et al., Effect of Insulation and Mass Distribution in Exterior Walls on Dynamic Thermal Performance of Whole Buildings, Thermal Envelopes VII/Building Systems—Principles p. 721-731, 1998, 11 pages.

* cited by examiner

THERMAL VENEER TIE AND ANCHORING SYSTEM

FIELD OF THE INVENTION

The present invention generally relates to anchoring systems for insulated cavity walls, and more specifically, a thermal veneer tie that creates a thermal break in a cavity wall.

BACKGROUND

Anchoring systems for cavity walls are used to secure veneer facings to a building and overcome seismic and other forces (e.g., wind shear, etc.). Anchoring systems generally form a conductive bridge or thermal pathway between the cavity and the interior of the building through metal-to-metal contact. Optimizing the thermal characteristics of cavity wall construction is important to ensure minimized heat transfer through the walls, both for comfort and for energy efficiency of heating and air conditioning. When the exterior is cold relative to the interior of a heated structure, heat from the interior should be prevented from passing through to the outside. Similarly, when the exterior is hot relative to the interior of an air conditioned structure, heat from the exterior should be prevented from passing through to the interior. The main cause of thermal transfer is the use of anchoring systems made largely of metal components (e.g., steel, wire formatives, metal plate components, etc.) that are thermally conductive. While providing the required high-strength within the cavity wall system, the use of metal components results in heat transfer. Failure to isolate the metal components of the anchoring system and break the thermal transfer results in heating and cooling losses and in potentially damaging condensation buildup within the cavity wall structure. However, a completely thermally-nonconductive anchoring system is not ideal because of the relative structural weakness of nonconductive materials.

SUMMARY

In one aspect, a veneer tie for use in a cavity wall to connect to a wall anchor to join an inner wythe and an outer wythe of the cavity wall includes an insertion portion configured for disposition in a bed joint of the outer wythe. A cavity portion is contiguous with the insertion portion, and a pintle is contiguous with the cavity portion and configured for attachment to a receptor of the wall anchor. A thermal coating is disposed on the pintle, the thermal coating being configured and arranged to reduce thermal transfer in the cavity wall between the veneer tie and the wall anchor when attached to the pintle.

In another aspect, an anchoring system for use in a cavity wall to join an inner wythe and an outer wythe of the cavity wall includes a wall anchor configured for attachment to the inner wythe, the wall anchor having at least one receptor. A veneer tie includes an insertion portion configured for disposition in a bed joint of the outer wythe and a cavity portion contiguous with the insertion portion. A pintle is contiguous with the cavity portion and configured for reception in the receptor of the wall anchor. A thermal coating is disposed on the pintle, the thermal coating being configured and arranged to reduce thermal transfer in the cavity wall between the veneer tie and the wall anchor when attached to the pintle.

Other objects and features will be in part apparent and in part pointed out hereinafter.

BRIEF DESCRIPTION OF THE DRAWINGS

Corresponding reference characters indicate corresponding parts throughout the drawings.

DESCRIPTION OF THE PREFERRED EMBODIMENTS

Figure 1:
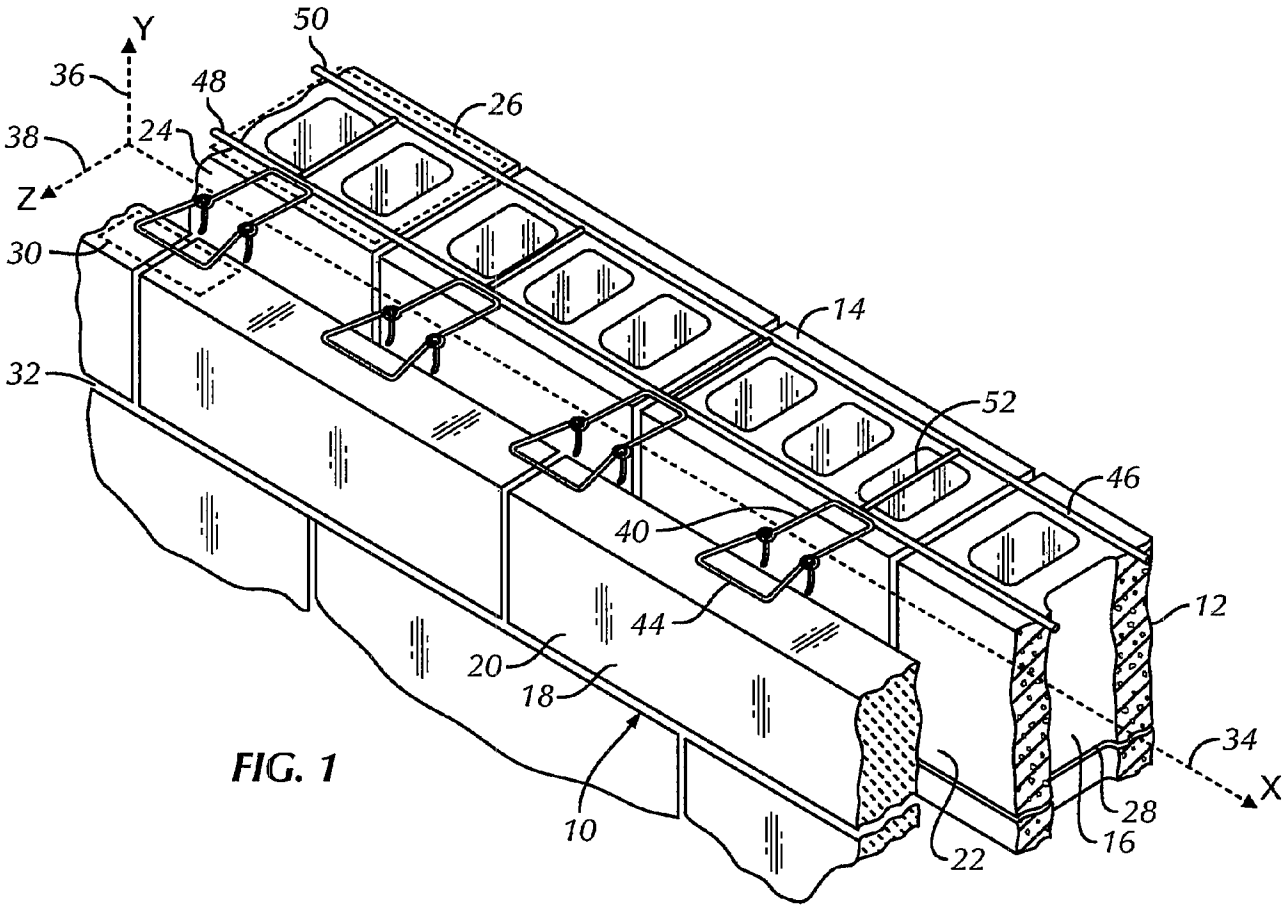
FIG. 1 is a perspective of an anchoring system as applied to a cavity wall with an inner wythe of masonry construction and an outer wythe of brick.
Figure 2:
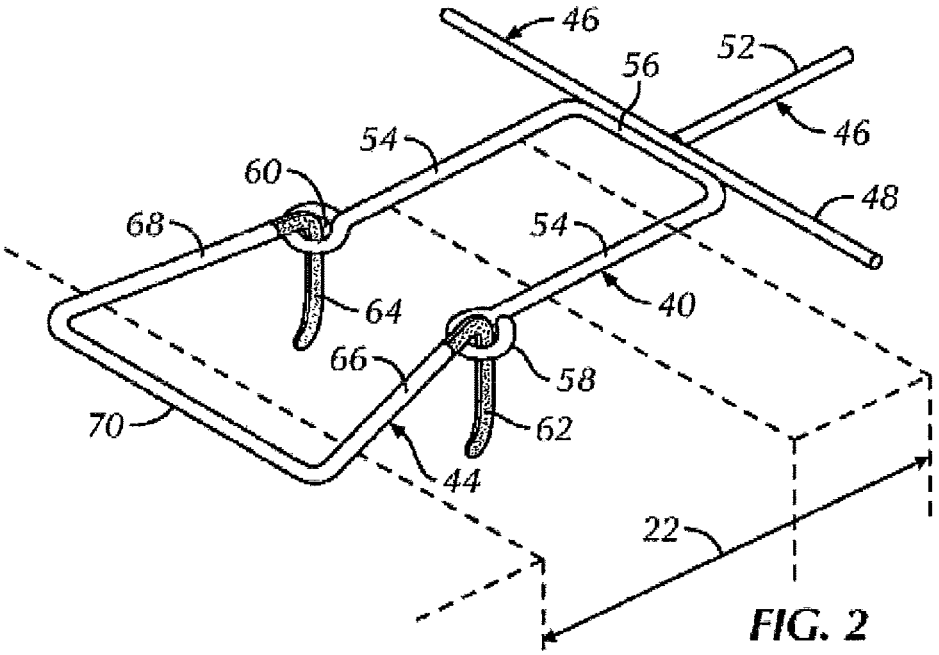
FIG. 2 is a fragmentary perspective, illustrating the anchoring system in use and showing a thermal veneer tie according to an embodiment of the present invention including a thermal coating on pintles of the veneer tie.

Referring to FIGS. 1 and 2, an anchoring system for cavity walls is shown generally at 10. A cavity wall structure generally indicated at 12 comprises an inner wythe or backup wall 14 of masonry block 16 and an outer wythe or facing wall 18 of brick 20 construction. Between the inner wythe 14 and the outer wythe 18, a cavity 22 is formed. An air/vapor barrier and/or insulation can be attached to an exterior surface of the inner wythe 14 (not shown). It is to be understood that the inner and outer wythes may have other constructions than described herein within the scope of the present invention.

Successive bed joints 26 and 28 are formed between courses of blocks 16 and are substantially planar and horizontally disposed. In addition, successive bed joints 30 and 32 are formed between courses of bricks 20 and are substantially planar and horizontally disposed. In accordance with building standards, the bed joints are approximately 0.375 inches (0.9525 cm) in height in a typical embodiment. Selective ones of bed joints 26, 28 receive a wall reinforcement 46. Selective ones of bed joints 30 and 32 receive the insertion portion of a veneer tie 44. A wall anchor 40 extends into the cavity 22 and is attached to the wall reinforcement 46 in a suitable manner, such as by welding. It is also contemplated that the wall anchor could be formed as one piece with the reinforcement. It is understood that the described and illustrated wall structure 12 is exemplary only. Other structures may be used without departing from the scope of the present invention. As described in greater detail below, the veneer tie 44 is configured to provide a thermal break in the cavity 22. The anchoring system 10 is constructed and configured to limit thermal transfer between the wall anchor 40 and the veneer tie 44.

For purposes of the description, an exterior cavity surface 24 of the inner wythe 14 contains a horizontal line or x-axis 34 and an intersecting vertical line or y-axis 36. A horizontal line or z-axis 38, normal to the xy-plane, passes through the coordinate origin formed by the intersecting x- and y-axes.

The wall reinforcement 46 includes parallel side wire members 48, 50 and intermediate wires 52 extending between the side wires. As illustrated in FIGS. 1 and 2, the intermediate wires 52 of the wall reinforcement 46 form a ladder formation, although other configurations (such as a truss formation) are within the scope of the present invention. At intervals along the wall reinforcement 46, wall anchors 40 extend from the wall reinforcement and into the cavity 22. Each wall anchor 40 includes a receptor portion for receiving the veneer tie 44. As seen in FIG. 2, the wall anchor 40 includes legs 54 attached to each other by a rear leg 56, which is attached to the side wire 48. Each of the legs 54 extends into the cavity 22 and includes a receptor portion 58 having an eye or aperture 60. The aperture 60 is configured to receive a pintle of the veneer tie 44 therethrough for attaching the veneer tie to the wall anchor 40. Other configurations of wall anchors are within the scope of the present invention.

Veneer tie 44 is shown in FIG. 1 as being placed on a course of bricks in preparation for being embedded in the mortar of bed joint 30. The veneer tie 44 is formed of wire and includes attachment portions or pintles 62, 64, cavity portions 66, 68, and insertion portion 70, which is received in the bed joint 30. The pintles 62, 64 are received in the apertures 60 of the wall anchor 40 to secure the veneer tie to the wall anchor. The pintles 62, 64 can be compressively reduced such that each pintle has a thickness extending along an x-vector, and a width extending along a z-vector, the width being greater than the thickness. Optionally, the insertion portion 70 can be compressively reduced in height (not shown). It is understood that neither the pintles nor the insertion portion need be compressively reduced within the scope of the present invention.

The veneer tie 44 includes a thermal coating that is configured to provide a thermal break in the cavity 22. The main components of the veneer tie are preferably made of metal (e.g., steel) to provide a high-strength anchoring system. Through the use of a thermal coating, the underlying metal components of the veneer tie obtain a lower thermal conductive value (K-value), thereby providing a high strength veneer tie with the benefits of thermal isolation. Likewise, the entire cavity wall 12 obtains a lower transmission value (U-value), thereby providing an anchoring system with the benefits of thermal isolation. The term K-value is used to describe the measure of heat conductivity of a particular material, i.e., the measure of the amount of heat, in BTUs per hour, that will be transmitted through one square foot of material that is one inch thick to cause a temperature change of one degree Fahrenheit from one side of the material to the other (BTU/(hr·ft·° F.); or W/(m·K) in SI units). The lower the K-value, the better the performance of the material as an insulator. The metal components of the anchoring systems generally have a K-value range of 16 to 116 W/(m·K) (about 9 to 67 BTU/(hr·ft·° F.)). The coated veneer tie as described below greatly reduces the K-values to a low thermal conductive K-value not to exceed 1 W/(m·K) (about 0.58 BTU/(hr·ft·° F.)), for example about 0.7 W/(m·K) (about 0.4 BTU/(hr·ft·° F.)). The term U-value is used to describe the transmission of heat through the entire cavity wall (including the veneer tie, the anchor, the insulation, and other components), i.e., the measure of the rate of transfer of heat through one square meter of a structure divided by the difference in temperature across the structure. Similar to the K-value, the lower the U-value, the better the thermal integrity of the cavity wall, and the higher the U-value, the worse the thermal performance of the building envelope. The U-value is calculated from the reciprocal of the combined thermal resistances of the materials in the cavity wall, taking into account the effect of thermal bridges, air gaps and fixings. Several factors affect the U-value, such as the size of the cavity, the thickness of the insulation, the materials used, etc. Desirably, the use of veneer ties as described herein may reduce the U-value of a wall by 5%-80%.

Figure 3:
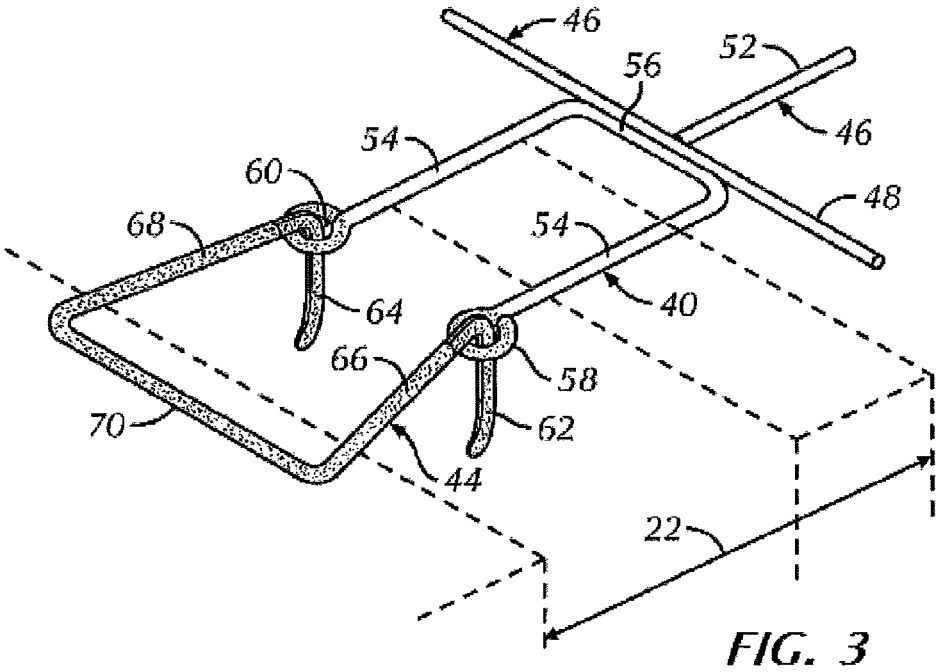
FIG. 3 is a fragmentary perspective, illustrating the anchoring system in use and showing a thermal veneer tie according to an embodiment of the present invention including a thermal coating applied to the entire veneer tie.

The pintles 62, 64 (i.e., the portion of the veneer tie 44 that contacts the wall anchor 40) are coated with a thermal coating to provide a thermal break in the cavity (FIG. 2). The coating is illustrated by stippling in FIGS. 2 and 3. Other portions of the veneer tie can also include a thermal coating. In one embodiment, the cavity portions 66, 68 include a thermal coating to reduce thermal transmission. In another embodiment, the insertion portion 70 includes a thermal coating. As illustrated in FIG. 3, the entire veneer tie 44 can be coated. Alternatively, portions of the tie 44 can be uncoated (e.g., the insertion portion 70 and/or the cavity portions 66, 68; FIG. 2). The thermal coating is selected from thermoplastics, thermosets, natural fibers, rubbers, resins, asphalts, ethylene propylene diene monomers, and admixtures thereof and can be applied in layers. The thermal coating optionally contains an isotropic polymer which includes, but is not limited to, acrylics, nylons, epoxies, silicones, polyesters, polyvinyl chlorides, polyethylenes, and chlorosulfonated polyethylenes. Alternatively, the thermal coating can be a ceramic or ceramic-based coating including materials selected from lanthanum, cerium, praseodymium, neodymium, promethium, samarium, europium, gadolinium, terbium, dysprosium, holmium, erbium, thulium, ytterbium, lutetium, indium, scandium, yttrium, zirconium, hathium, titanium, silica, zirconia, magnesium zirconate, yttria-stabilized zirconia, and derivatives and admixtures thereof. An initial layer of the thermal coating can be cured to provide a pre-coat and the layers of the thermal coating can be cross-linked to provide high-strength adhesion to the veneer tie to resist chipping or wearing of the thermal coating.

The thermal coating reduces the K-value of the underlying metal components which include, but are not limited to, mill galvanized, hot galvanized, and stainless steel. Such components have K-values that range from 16 to 116 W/(m·K). The thermal coating reduces the K-value of the veneer tie to not exceed 1.0 W/(m·K). Likewise, the thermal veneer tie reduces the U-value of the cavity wall structure. Preferably, the U-value of the cavity wall structure including the thermal veneer tie is reduced by 5-80% as compared to the U-value of the cavity wall structure including a veneer tie without the thermal coating described herein. The thermal coating is fire resistant and gives off no toxic smoke in the event of a fire. Furthermore, the coating is suited to the application in an anchoring system with characteristics such as shock resistance, non-frangibility, low thermal conductivity and transmissivity, and a non-porous resilient finish. Additionally, the thermal coating can provide corrosion protection which protects against deterioration of the anchoring system over time.

The thermal coating can be applied through any number of methods including fluidized bed production, thermal spraying, hot dip processing, heat-assisted fluid coating, or extrusion, and includes both powder and fluid coating to form a reasonably uniform coating. The coating preferably has a thickness selected to provide a thermal break in the cavity. In one embodiment, the thickness of the coating is at least about 3 microns, such as a thickness in the range of approximately 3 microns to approximately 300 microns, and in one embodiment is about 127 microns. The thermal coating is cured to achieve good cross-linking of the layers. Appropriate examples of the nature of the coating and application process are set forth in U.S. Pat. Nos. 6,284,311 and 6,612,343.

Optionally, the wall anchor 40 can also include a thermal coating as described above. All or a portion of the wall anchor 40 and the wall reinforcement 46 can be coated to provide a thermal break in the cavity wall structure. In one embodiment, the receptor portions 58 (i.e., the portion of the wall anchor 40 that contacts the veneer tie 44) include a thermal coating (shown by stippling on the wall anchor in FIG. 3). In another embodiment, the legs 54 of the wall anchor 40 include a thermal coating (not shown). In another embodiment, the wall reinforcement 46 includes a thermal coating (not shown).

Figure 4:
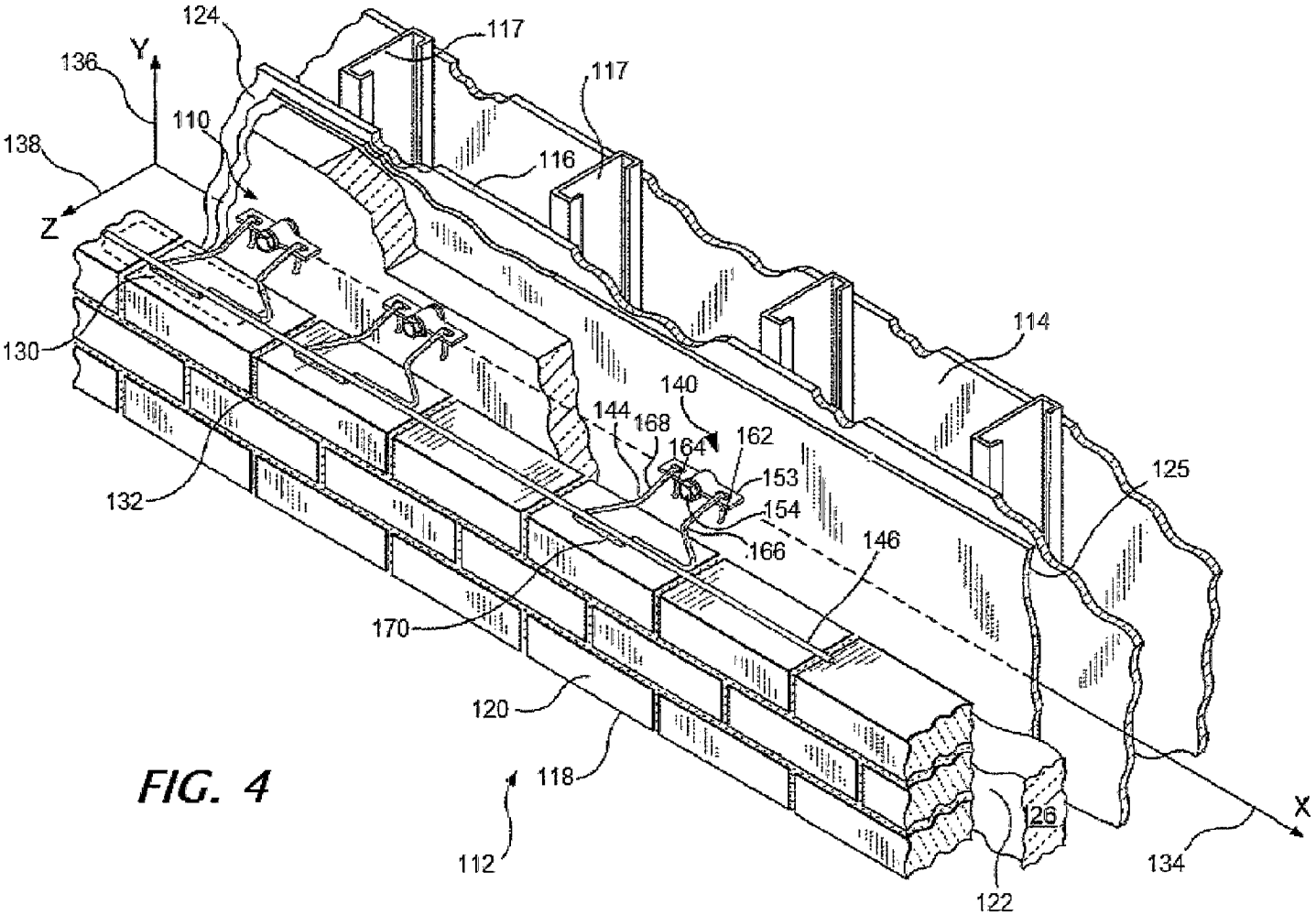
FIG. 4 is a perspective of an anchoring system as applied to a cavity wall with an inner wythe of an insulated dry wall construction and an outer wythe of brick.
Figure 5:
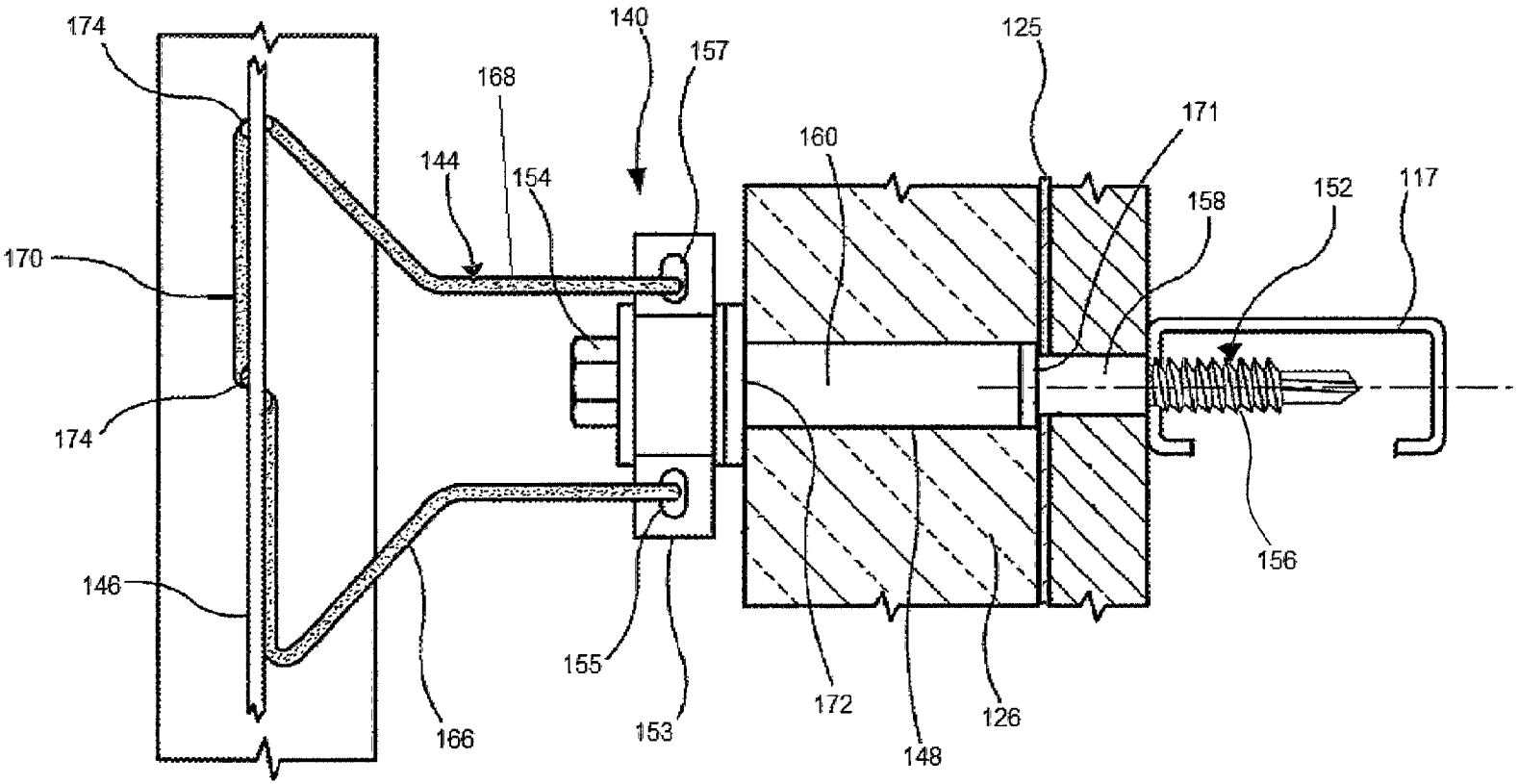
FIG. 5 is a fragmentary schematic top plan view, partially in section, illustrating the anchoring system in use.

Referring to FIGS. 4 and 5, a second embodiment of an anchoring system for cavity walls is shown generally at 110. A cavity wall structure generally indicated at 112 comprises an inner wythe or drywall backup 114 with sheetrock or wallboard 116 mounted on metal columns or studs 117 and an outer wythe or facing wall 118 constructed of bricks 120. Between the inner wythe 114 and the outer wythe 118, a cavity 122 is formed. An air/vapor barrier 125 and insulation 126 are attached to an exterior surface 124 of the inner wythe 114.

Successive bed joints 130 and 132 are formed between courses of bricks 120 and are substantially planar and horizontally disposed. In accordance with building standards, the bed joints are approximately 0.375 inches (0.9525 cm) in height in a typical embodiment. Selective ones of bed joints 130 and 132 receive the insertion portion of a veneer tie 144. A wall anchor 140 is threadedly mounted on the inner wythe 114 and is supported by the inner wythe. It is understood that the described and illustrated wall structure 112 is exemplary only. Other structures may be used without departing from the scope of the present invention. As described in greater detail below, the veneer tie 144 is configured to provide a thermal break in the cavity 122. The anchoring system 110 is constructed and configured to limit thermal transfer between the wall anchor 140 and the veneer tie 144.

For purposes of the description, an exterior cavity surface 124 of the inner wythe 114 contains a horizontal line or x-axis 134 and an intersecting vertical line or y-axis 136. A horizontal line or z-axis 138, normal to the xy-plane, passes through the coordinate origin formed by the intersecting x- and y-axes.

In the illustrated embodiment, the anchoring system 110 includes wall anchor 140, veneer tie 144, and an optional wire or outer wythe reinforcement 146. At intervals along the exterior surface 124 of the inner wythe 114, wall anchors 140 are driven into place in anchor-receiving channels 148 (see FIG. 5). Each wall anchor 140 includes a receptor portion for receiving the veneer tie 144. As seen in FIG. 5, the wall anchor 140 has an elongate body extending from a driven end portion 152 to a driving end portion 154. The driven end portion 152 includes a threaded portion 156 (e.g., a self-drilling screw portion) configured for attachment to the inner wythe 114. The wall anchor 140 includes a dual-diameter barrel with a smaller diameter barrel or first shaft portion 158 toward the driven end portion 152 and a larger diameter barrel or second shaft portion 160 toward the driving end portion 154. The wall anchor 140 includes a wing nut 153 having receptors or apertures 155, 157 configured to receive pintles of the veneer tie 144. The wall anchor 140 optionally includes an internal seal 171 at the juncture of the first shaft portion 158 and the second shaft portion 160 and an external seal 172 at the juncture of the second shaft portion and the wing nut 153 to prevent air and moisture penetration through the cavity wall structure.

Veneer tie 144 is shown in FIG. 4 as being placed on a course of bricks in preparation for being embedded in the mortar of bed joint 130. The veneer tie 144 is formed of wire and includes attachment portions or pintles 162, 164, cavity portions 166, 168, and insertion portion 170, which is received in the bed joint 130. The pintles 162, 164 are received in the apertures 155, 157 of the wall anchor 140 to secure the veneer tie to the wall anchor. The pintles 162, 164 can be compressively reduced such that each pintle has a thickness extending along an x-vector, and a width extending along a z-vector, the width being greater than the thickness (not shown). Optionally, the insertion portion 170 can be compressively reduced in height (not shown). It is understood that neither the pintles nor the insertion portion need be compressively reduced within the scope of the present invention. As illustrated, the veneer tie 144 is configured to receive wire reinforcement 146. The insertion portion 170 of veneer tie 144 includes a swaged area 174 for receiving the reinforcement 146.

The veneer tie 144 includes a thermal coating that is configured to provide a thermal break in the cavity 122. The main components of the veneer tie are preferably made of metal (e.g., steel) to provide a high-strength anchoring system. Through the use of a thermal coating, the underlying metal components of the veneer tie obtain a lower thermal conductive value (K-value), thereby providing a high strength veneer tie with the benefits of thermal isolation. Likewise, the entire cavity wall 112 obtains a lower transmission value (U-value), thereby providing an anchoring system with the benefits of thermal isolation. The pintles 162, 164 (i.e., the portion of the veneer tie 144 that contacts the wall anchor 140) are coated with a thermal coating to provide a thermal break in the cavity. The coating is illustrated by stippling in FIGS. 4 and 5. Other portions of the veneer tie can also include a thermal coating. In one embodiment, the cavity portions 166, 168 include a thermal coating to reduce thermal transmission. In another embodiment, the insertion portion 170 includes a thermal coating. The entire veneer tie 144 can be coated, as illustrated. Alternatively, portions of the tie 144 can be uncoated (e.g., the insertion portion 170 and/or the cavity portions 166, 168). The thermal coating is selected from thermoplastics, thermosets, natural fibers, rubbers, resins, asphalts, ethylene propylene diene monomers, and admixtures thereof and can be applied in layers. The thermal coating optionally contains an isotropic polymer which includes, but is not limited to, acrylics, nylons, epoxies, silicones, polyesters, polyvinyl chlorides, polyethylenes, and chlorosulfonated polyethylenes. Alternatively, the thermal coating can be a ceramic or ceramic-based coating including materials selected from lanthanum, cerium, praseodymium, neodymium, promethium, samarium, europium, gadolinium, terbium, dysprosium, holmium, erbium, thulium, ytterbium, lutetium, indium, scandium, yttrium, zirconium, hafnium, titanium, silica, zirconia, magnesium zirconate, yttria-stabilized zirconia, and derivatives and admixtures thereof. An initial layer of the thermal coating can be cured to provide a pre-coat and the layers of the thermal coating can be cross-linked to provide high-strength adhesion to the veneer tie to resist chipping or wearing of the thermal coating.

The thermal coating reduces the K-value of the underlying metal components which include, but are not limited to, mill galvanized, hot galvanized, and stainless steel. Such components have K-values that range from 16 to 116 W/(m·K). The thermal coating reduces the K-value of the veneer tie to not exceed 1.0 W/(m·K). Likewise, the thermal veneer tie reduces the U-value of the cavity wall structure. Preferably, the U-value of the cavity wall structure including the thermal veneer tie is reduced by 5-80% as compared to the U-value of the cavity wall structure including a veneer tie without the thermal coating described herein. The thermal coating is fire resistant and gives off no toxic smoke in the event of a fire. Furthermore, the coating is suited to the application in an anchoring system with characteristics such as shock resistance, non-frangibility, low thermal conductivity and transmissivity, and a non-porous resilient finish. Additionally, the thermal coating can provide corrosion protection which protects against deterioration of the anchoring system over time.

The thermal coating can be applied through any number of methods including fluidized bed production, thermal spraying, hot dip processing, heat-assisted fluid coating, or extrusion, and includes both powder and fluid coating to form a reasonably uniform coating. The coating preferably has a thickness selected to provide a thermal break in the cavity. In one embodiment, the thickness of the coating is at least about 3 microns, such as a thickness in the range of approximately 3 microns to approximately 300 microns, and in one embodiment is about 127 microns. The thermal coating is cured to achieve good cross-linking of the layers. Appropriate examples of the nature of the coating and application process are set forth in U.S. Pat. Nos. 6,284,311 and 6,612,343.

Optionally, the wall anchor 140 can also include a thermal coating as described above (not shown). All or a portion of the wall anchor 140 can be coated to provide a thermal break in the cavity wall structure. In one embodiment, walls of the apertures 155, 157 (i.e., the portion of the wall anchor 140 that contacts the veneer tie 144) include a thermal coating. In another embodiment, the entire wing nut 153 includes a thermal coating. In another embodiment, the entire wall anchor except for the threaded portion 156 includes a thermal coating.

Figure 6:
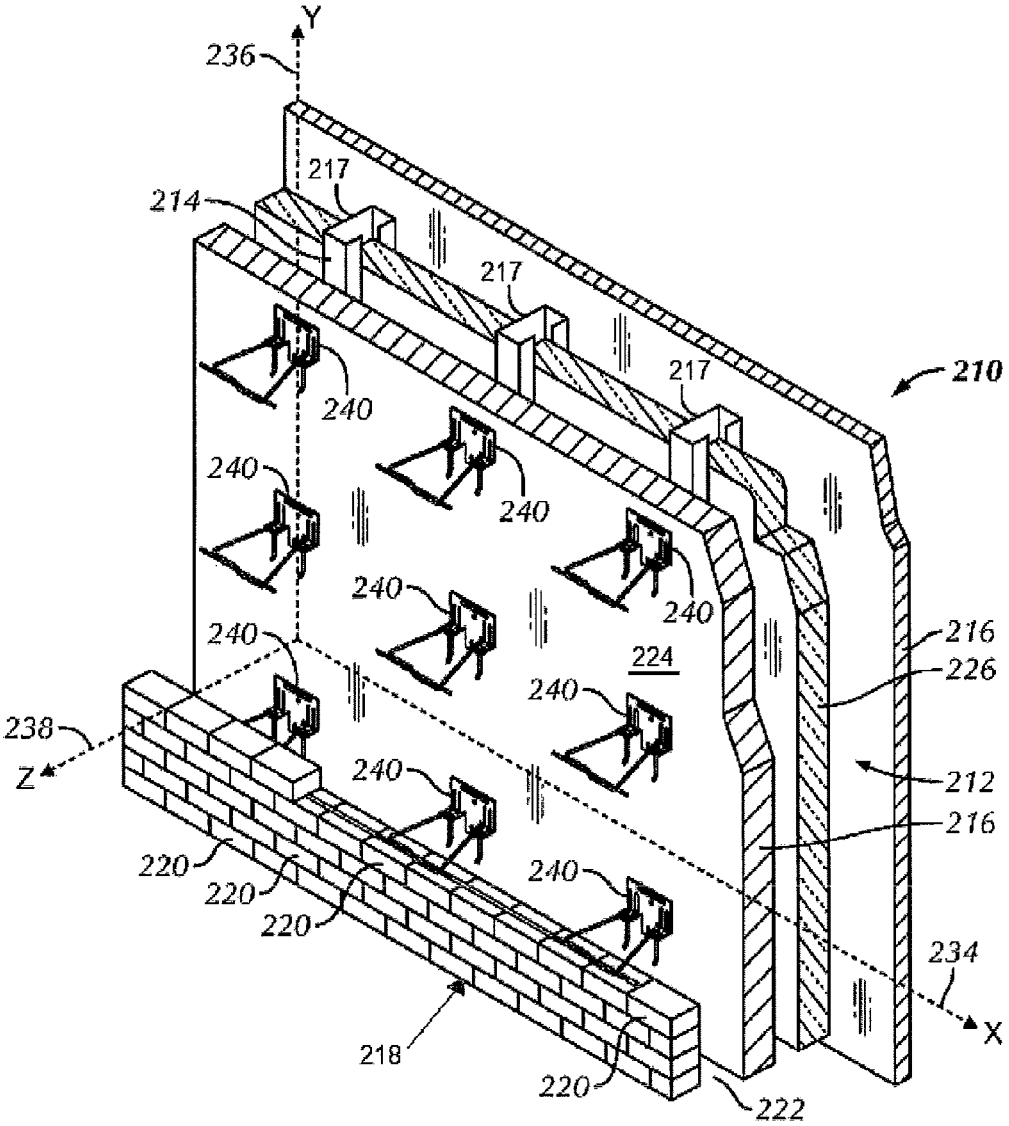
FIG. 6 is a perspective of a surface-mounted anchoring system as applied to a cavity wall with an inner wythe of dry wall construction and an outer wythe of brick.
Figure 7:
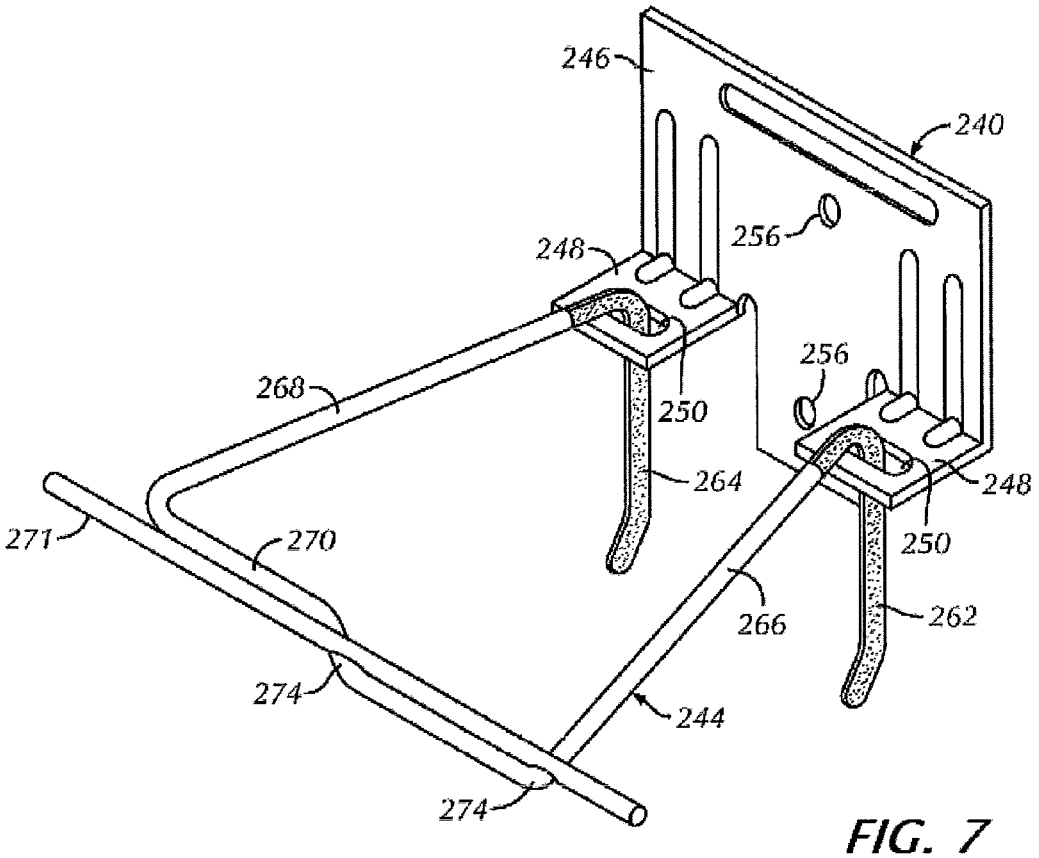
FIG. 7 is a schematic perspective illustrating the surface-mounted anchoring system in use and showing a thermal veneer tie according to an embodiment of the present invention.

Referring now to FIGS. 6 and 7, a third embodiment of an anchoring system for cavity walls is shown generally at 210. A cavity wall structure generally indicated at 212 comprises an inner wythe or backup wall 214 having sheetrock or wallboard 216 mounted on columns or studs 217 and an outer wythe or facing wall 218 of brick 220 construction. Between the inner wythe 214 and the outer wythe 218, a cavity 222 is formed. Insulation 226 is disposed between adjacent studs 217.

Successive bed joints are formed between courses of bricks 220 and are substantially planar and horizontally disposed. In accordance with building standards, the bed joints are approximately 0.375 inches (0.9525 cm) in height in a typical embodiment. Selective ones of bed joints are constructed to receive the insertion portion of a veneer tie 244. A wall anchor 240 is surface-mounted on the inner wythe 214 and is supported by the inner wythe. It is understood that the described and illustrated wall structure 212 is exemplary only. Other structures may be used without departing from the scope of the present invention. As described in greater detail below, the veneer tie 244 is configured to provide a thermal break in the cavity 222. The anchoring system 210 is constructed and configured to limit thermal transfer between the wall anchor 240 and the veneer tie 244.

For purposes of the description, an exterior cavity surface 224 of the inner wythe 214 contains a horizontal line or x-axis 234 and an intersecting vertical line or y-axis 236. A horizontal line or z-axis 238, normal to the xy-plane, passes through the coordinate origin formed by the intersecting x- and y-axes.

At intervals along the inner wythe 214, wall anchors 240 are mounted and extend into the cavity 222. Each wall anchor 240 includes a receptor portion for receiving the veneer tie 244. As seen in FIG. 7, the wall anchor 240 includes a base plate member 246 and a free end portion 248 extending into the cavity 222. The free end portion 248 includes receptor portions 250 configured to receive the pintles of the veneer tie 244 therethrough to attach the veneer tie to the wall anchor 240. The wall anchors 240 are mounted to the inner wythe 214 by fasteners extending through mounting holes 256 in the base plate member 246.

The veneer tie 244 is formed of wire and includes attachment portions or pintles 262, 264, cavity portions 266, 268, and insertion portion 270, which is received in a bed joint of the outer wythe 218. The pintles 262, 264 are received in the receptor portions 250 of the wall anchor 240 to secure the veneer tie to the wall anchor. The pintles 262, 264 can be compressively reduced such that each pintle has a thickness extending along an x-vector, and a width extending along a z-vector, the width being greater than the thickness. Optionally, the insertion portion 270 can be compressively reduced in height (not shown). It is understood that neither the pintles nor the insertion portion need be compressively reduced within the scope of the present invention. As illustrated, the veneer tie 244 is configured to receive a wire reinforcement 271. The insertion portion 270 of the veneer tie 244 includes swaged areas 274 for receiving the reinforcement 271.

The veneer tie 244 includes a thermal coating that is configured to provide a thermal break in the cavity 222. The main components of the veneer tie are preferably made of metal (e.g., steel) to provide a high-strength anchoring system. Through the use of a thermal coating, the underlying metal components of the veneer tie obtain a lower thermal conductive value (K-value), thereby providing a high strength veneer tie with the benefits of thermal isolation. Likewise, the entire cavity wall 212 obtains a lower transmission value (U-value), thereby providing an anchoring system with the benefits of thermal isolation. The pintles 262, 264 (i.e., the portion of the veneer tie 244 that contacts the wall anchor 240) are coated with a thermal coating to provide a thermal break in the cavity (FIG. 7). The coating is illustrated by stippling in FIG. 7. Other portions of the veneer tie can also include a thermal coating. In one embodiment, the cavity portions 266, 268 include a thermal coating (not shown) to reduce thermal transmission. In another embodiment, the insertion portion 270 includes a thermal coating (not shown). As illustrated, portions of the tie 244 can be uncoated (e.g., the insertion portion 270 and/or the cavity portions 266, 268; FIG. 7). Alternatively, the entire veneer tie 244 can be coated (not shown). The thermal coating is selected from thermoplastics, thermosets, natural fibers, rubbers, resins, asphalts, ethylene propylene diene monomers, and admixtures thereof and can be applied in layers. The thermal coating optionally contains an isotropic polymer which includes, but is not limited to, acrylics, nylons, epoxies, silicones, polyesters, polyvinyl chlorides, polyethylenes, and chlorosulfonated polyethylenes. Alternatively, the thermal coating can be a ceramic or ceramic-based coating including materials selected from lanthanum, cerium, praseodymium, neodymium, promethium, samarium, europium, gadolinium, terbium, dysprosium, holmium, erbium, thulium, ytterbium, lutetium, indium, scandium, yttrium, zirconium, hathium, titanium, silica, zirconia, magnesium zirconate, yttria-stabilized zirconia, and derivatives and admixtures thereof. An initial layer of the thermal coating can be cured to provide a pre-coat and the layers of the thermal coating can be cross-linked to provide high-strength adhesion to the veneer tie to resist chipping or wearing of the thermal coating.

The thermal coating reduces the K-value of the underlying metal components which include, but are not limited to, mill galvanized, hot galvanized, and stainless steel. Such components have K-values that range from 16 to 116 W/(m·K). The thermal coating reduces the K-value of the veneer tie to not exceed 1.0 W/(m·K). Likewise, the thermal veneer tie reduces the U-value of the cavity wall structure. Preferably, the U-value of the cavity wall structure including the thermal veneer tie is reduced by 5-80% as compared to the U-value of the cavity wall structure including a veneer tie without the thermal coating described herein. The thermal coating is fire resistant and gives off no toxic smoke in the event of a fire. Furthermore, the coating is suited to the application in an anchoring system with characteristics such as shock resistance, non-frangibility, low thermal conductivity and transmissivity, and a non-porous resilient finish. Additionally, the thermal coating can provide corrosion protection which protects against deterioration of the anchoring system over time.

The thermal coating can be applied through any number of methods including fluidized bed production, thermal spraying, hot dip processing, heat-assisted fluid coating, or extrusion, and includes both powder and fluid coating to form a reasonably uniform coating. The coating preferably has a thickness selected to provide a thermal break in the cavity. In one embodiment, the thickness of the coating is at least about 3 microns, such as a thickness in the range of approximately 3 microns to approximately 300 microns, and in one embodiment is about 127 microns. The thermal coating is cured to achieve good cross-linking of the layers. Appropriate examples of the nature of the coating and application process are set forth in U.S. Pat. Nos. 6,284,311 and 6,612,343.

Optionally, the wall anchor 240 can also include a thermal coating (not shown) as described above. All or a portion of the wall anchor 240 can be coated to provide a thermal break in the cavity wall structure. In one embodiment, the receptor portions 250 (i.e., the portion of the wall anchor 240 that contacts the veneer tie 244) include a thermal coating (not shown). In another embodiment, the free end portions 248 of the wall anchor 240 include a thermal coating (not shown). In another embodiment, the wall base plate member 246 includes a thermal coating (not shown).

The veneer ties as described above serve to thermally isolate the components of the anchoring system, thereby reducing the thermal transmission and conductivity values of the anchoring system as a whole. The veneer ties provide an insulating effect and an in-cavity thermal break, severing the thermal pathways created from metal-to-metal contact of anchoring system components. Through the use of the thermally-isolating veneer ties, the underlying metal components obtain a lower thermal conductive value (K-value), thereby reducing the thermal transmission value (U-value) of the entire cavity wall structure. The present invention maintains the strength of the metal and further provides the benefits of a thermal break in the cavity.

Having described the invention in detail, it will be apparent that modifications and variations are possible without departing from the scope of the invention defined in the appended claims.

When introducing elements of the present invention or the preferred embodiment(s) thereof, the articles "a", "an", "the" and "said" are intended to mean that there are one or more of the elements. The terms "comprising", "including" and "having" are intended to be inclusive and mean that there may be additional elements other than the listed elements.

As various changes could be made in the above products without departing from the scope of the invention, it is intended that all matter contained in the above description and shown in the accompanying drawings shall be interpreted as illustrative and not in a limiting sense.

What is claimed is:

1. A veneer tie for use in a cavity wall to connect to a wall anchor to join an inner wythe and an outer wythe of the cavity wall, the veneer tie comprising:

an insertion portion configured for disposition in a bed joint of the outer wythe;

a cavity portion contiguous with the insertion portion;

a pintle contiguous with the cavity portion and configured for attachment to a receptor of the wall anchor; and a thermal coating disposed on the pintle, the thermal coating being configured and arranged to reduce thermal transfer in the cavity wall between the veneer tie and the wall anchor when attached to the pintle.

2. The veneer tie of claim 1, wherein the thermal coating is a material selected from the group consisting of thermoplastics, thermosets, natural fibers, rubber, resins, asphalts, ethylene propylene diene monomers, and admixtures thereof.

3. The veneer tie of claim 2, wherein the thermal coating is an isotropic polymer selected from the group consisting of acrylics, nylons, epoxies, silicones, polyesters, polyvinyl chlorides, and polyethylenes.

4. The veneer tie of claim 1, wherein the thermal coating is a material selected from the group consisting of lanthanum, cerium, praseodymium, neodymium, promethium, samarium, europium, gadolinium, terbium, dysprosium, holmium, erbium, thulium, ytterbium, lutetium, indium, scandium, yttrium, zirconium, hafnium, titanium, silica, zirconia, magnesium zirconate, yttria-stabilized zirconia, and derivatives and admixtures thereof.

5. The veneer tie of claim 1, wherein the thermal coating reduces the K-value of the wall anchor to a level not to exceed 1.0 W/(m·K).

6. The veneer tie of claim 1, wherein the thermal coating has a thickness of at least about 3 microns.

7. The veneer tie of claim 1, wherein the thermal coating comprises more than one layer to provide high-strength adhesion to the pintle.

8. The veneer tie of claim 1, wherein the thermal coating is disposed on the cavity portion.

9. The veneer tie of claim 1, wherein the thermal coating is disposed on the insertion portion.

10. The veneer tie of claim 1, wherein the thermal coating is disposed on the cavity portion and the insertion portion.

11. The veneer tie of claim 1, wherein the cavity portion is free from thermal coating.

12. The veneer tie of claim 1, comprising a pair of cavity portions contiguous with the insertion portion and a pair of pintles each contiguous with a respective one of the cavity portions, wherein the thermal coating is disposed on each of the pintles.

13. The veneer tie of claim 1, wherein the pintle is compressively reduced such that the pintle has a thickness and a width greater than the thickness.

14. The veneer tie of claim 1, wherein the insertion portion is swaged to receive a reinforcement wire.

15. An anchoring system for use in a cavity wall to join an inner wythe and an outer wythe of the cavity wall, the anchoring system comprising:

a wall anchor configured for attachment to the inner wythe, the wall anchor having at least one receptor; and a veneer tie comprising:

an insertion portion configured for disposition in a bed joint of the outer wythe;

a cavity portion contiguous with the insertion portion;

a pintle contiguous with the cavity portion and configured for reception in the receptor of the wall anchor; and a thermal coating disposed on the pintle, the thermal coating being configured and arranged to reduce thermal transfer in the cavity wall between the veneer tie and the wall anchor when attached to the pintle.

16. The anchoring system of claim 15, wherein the wall anchor comprises a thermal coating disposed on the receptor for reducing thermal transfer between the veneer tie and the wall anchor.

17. The anchoring system of claim 15, wherein the thermal coating is selected from the group consisting of thermoplastics, thermosets, natural fibers, rubber, resins, asphalts, ethylene propylene diene monomers, acrylics, nylons, epoxies, silicones, polyesters, polyvinyl chlorides, polyethylenes, chlorosulfonated polyethylenes, lanthanum, cerium, praseodymium, neodymium, promethium, samarium, europium, gadolinium, terbium, dysprosium, holmium, erbium, thulium, ytterbium, lutetium, indium, scandium, yttrium, zirconium, hathium, titanium, silica, zirconia, magnesium zirconate, yttria-stabilized zirconia, and derivatives and admixtures thereof.

18. The anchoring system of claim 15, wherein the thermal coating is disposed on the cavity portion and the insertion portion.

19. The anchoring system of claim 15, wherein the cavity portion is free from thermal coating.

20. The anchoring system of claim 15, wherein the veneer tie comprises a pair of cavity portions contiguous with the insertion portion and a pair of pintles each contiguous with a respective one of the cavity portions, wherein the thermal coating is disposed on each of the pintles.

* * * * *